US007246704B2

(12) United States Patent
Brunson et al.

(10) Patent No.: US 7,246,704 B2
(45) Date of Patent: Jul. 24, 2007

(54) TOOL AND ACCESSORY CONTAINER WITH INNER GRID SYSTEM

(75) Inventors: Mark E Brunson, Bel Air, MD (US); David L Wikle, York, PA (US); Jennifer R Ervin, Annapolis, MD (US)

(73) Assignee: Black & Decker Inc., Newark, DE (US)

( * ) Notice: Subject to any disclaimer, the term of this patent is extended or adjusted under 35 U.S.C. 154(b) by 161 days.

(21) Appl. No.: 10/958,129

(22) Filed: Oct. 4, 2004

(65) Prior Publication Data

US 2006/0070900 A1 Apr. 6, 2006

(51) Int. Cl.
*B65D 85/28* (2006.01)
*B65D 21/02* (2006.01)

(52) U.S. Cl. ..... 206/372; 220/23.4; 220/23.88

(58) Field of Classification Search ..... 206/369–373, 206/557–565; 220/23.2–23.8, 23.88, 23.89
See application file for complete search history.

(56) References Cited

U.S. PATENT DOCUMENTS

| | | | | |
|---|---|---|---|---|
| 337,888 | A | 3/1886 | Swan | |
| 470,567 | A | 3/1892 | Hitch | |
| 498,455 | A | 5/1893 | Bartlett | |
| 1,927,110 | A | 9/1933 | Bannister et al. | |
| 2,487,174 | A | 11/1949 | Petre | |
| 2,508,951 | A | 5/1950 | Kazimier | |
| 2,601,101 | A | 6/1952 | Derham | |
| 2,614,399 | A * | 10/1952 | Roethel | 220/23.88 |
| D178,627 | S | 9/1956 | Baratelli | |
| 2,784,840 | A * | 3/1957 | Stefanik | 206/560 |
| 2,792,934 | A | 5/1957 | Rocchetti | |
| 2,844,244 | A | 7/1958 | Hanson | |
| 2,880,857 | A | 4/1959 | Parsons et al. | |
| 3,018,876 | A | 1/1962 | Huot | |
| 3,276,847 | A | 10/1966 | Duff et al. | |
| 3,367,483 | A | 2/1968 | Studen | |
| 3,370,697 | A | 2/1968 | Levey et al. | |
| 3,426,890 | A | 2/1969 | Bayer | |
| 3,583,556 | A | 6/1971 | Wagner | |
| D221,317 | S | 7/1971 | Muller | |
| D229,366 | S | 11/1973 | Yonce | |
| 3,904,034 | A | 9/1975 | Saunders | |
| 4,048,051 | A | 9/1977 | Gretz | |
| 4,154,795 | A * | 5/1979 | Thorne | 220/23.2 |
| 4,253,830 | A | 3/1981 | Kazen et al. | |

(Continued)

FOREIGN PATENT DOCUMENTS

| | | |
|---|---|---|
| DE | 1085810 | 7/1960 |

(Continued)

*Primary Examiner*—Bryon P. Gehman
(74) *Attorney, Agent, or Firm*—Harness, Dickey & Pierce, P.L.C.

(57) ABSTRACT

A tool container includes first and second container members rotatably connected to create an inner compartment. Each member has a compartment outer wall and integrally formed perimeter walls. A grid system is created on an inner compartment facing surface adjacent at least one of the compartment outer walls. The grid system includes female receptacles arranged in each of a plurality of rows and columns. Tool packages having at least one male peg member are releasably engaged within selected receptacles providing multiple locations and orientations about the grid system for the tool packages.

42 Claims, 8 Drawing Sheets

U.S. PATENT DOCUMENTS

| | | | | |
|---|---|---|---|---|
| 4,340,139 | A | 7/1982 | Wilcox et al. | |
| 4,340,140 | A | 7/1982 | Wilcox et al. | |
| D269,648 | S | 7/1983 | Wilcox et al. | |
| 4,446,966 | A | 5/1984 | Moloney | |
| 4,489,830 | A | 12/1984 | Charlebois et al. | |
| 4,576,307 | A | 3/1986 | Frydenberg | |
| 4,615,464 | A | 10/1986 | Byrns | |
| D291,946 | S | 9/1987 | Dottori et al. | |
| 4,778,047 | A | 10/1988 | Lay | |
| 4,838,445 | A | 6/1989 | Lanius | |
| 4,884,689 | A | 12/1989 | Su-Chin | |
| 4,974,740 | A | 12/1990 | Niles et al. | |
| D314,669 | S | 2/1991 | Kunimune | |
| 5,031,768 | A | 7/1991 | Fischer | |
| 5,114,007 | A | 5/1992 | Chen | |
| 5,133,455 | A | 7/1992 | Chow | |
| 5,172,810 | A * | 12/1992 | Brewer | 206/369 |
| 5,199,567 | A * | 4/1993 | Discko, Jr. | 206/369 |
| 5,201,414 | A | 4/1993 | Kaszubinski | |
| 5,341,926 | A | 8/1994 | Leben | |
| 5,368,164 | A | 11/1994 | Bennet et al. | |
| 5,525,314 | A | 6/1996 | Hurson | |
| 5,553,710 | A | 9/1996 | Takama | |
| 5,570,784 | A | 11/1996 | Sidabras et al. | |
| 5,590,770 | A | 1/1997 | Yeh | |
| 5,593,058 | A | 1/1997 | Spencer et al. | |
| 5,676,254 | A | 10/1997 | Cheng et al. | |
| 5,803,254 | A | 9/1998 | Vasudeva | |
| 5,826,719 | A | 10/1998 | Chen | |
| 5,915,554 | A | 6/1999 | Hung | |
| 5,918,740 | A * | 7/1999 | Berry, Jr. | 206/369 |
| 6,044,973 | A | 4/2000 | Vasudeva | |
| 6,105,767 | A | 8/2000 | Vasudeva | |
| 6,109,436 | A * | 8/2000 | He | 206/373 |
| 6,213,296 | B1 | 4/2001 | Streich et al. | |
| 6,315,154 | B1 | 11/2001 | Newby, Sr. | |
| 6,405,864 | B1 | 6/2002 | Streich et al. | |
| 6,415,922 | B1 | 7/2002 | Lee | |
| 6,626,295 | B1 | 9/2003 | Vasudeva | |
| 6,634,728 | B1 * | 10/2003 | Leguin | 312/348.3 |
| 6,739,452 | B2 * | 5/2004 | Rochelo | 206/454 |
| 6,755,302 | B1 | 6/2004 | Streich et al. | |
| 6,769,538 | B2 * | 8/2004 | Oswald | 206/77.1 |
| 2003/0006157 | A1 | 1/2003 | Vasudeva | |
| 2003/0010660 | A1 | 1/2003 | Lai | |
| 2004/0069668 | A1 | 4/2004 | Finnigan | |

FOREIGN PATENT DOCUMENTS

| | | |
|---|---|---|
| DE | 2319334 | 11/1974 |
| DE | 7821932 | 11/1978 |
| DE | 7837195 | 12/1978 |
| DE | 297 12619 | 1/1998 |
| DE | 19822972 | 3/1999 |
| DE | 29823041 | 5/1999 |
| DE | 20012186 | 11/2000 |
| DE | 20014052 | 1/2001 |
| DE | 20307875 | 11/2003 |
| DE | 10359266 | 7/2004 |
| DE | 202005000494 | 6/2005 |
| EP | 0270845 | 11/1987 |
| NR | 1977800 | 1/1968 |
| WO | WO 86/00600 | 1/1986 |
| WO | WO 00/09421 | 2/2000 |
| WO | WO 01/74545 | 10/2001 |

* cited by examiner

TOOL AND ACCESSORY CONTAINER WITH INNER GRID SYSTEM

FIELD OF THE INVENTION

The present invention relates in general to containers for storing articles and more specifically to a device and method for use of a molded plastic container for storing tools and tool accessories.

BACKGROUND OF THE INVENTION

Cases for storing tools or tool accessories are well known, and typically include a base in the form of an open-topped box, and usually a hinged lid, or two container halves joined by a hinge. At least one catch or clip is provided to retain the container in a closed position and a handle is also typically provided for user convenience. A cavity created between the box and lid or between the two halves provides space for storage of individual tools and/or tool accessories including driver heads, etc. Frequently, an insert is positioned within the cavity which is preformed having a plurality of outline shapes or forms of the tools or accessories intended to be stored. Each tool or accessory is positioned within these preformed, usually molded, forms. Other case designs provide individual sub-containers which themselves contain selected tools or accessories, which are commonly positioned at a single location within the cavity.

Tool cases are commonly molded of polymeric materials to reduce weight and provide a durable design. Molds or tooling for the case members are typically not easily reconfigured to accommodate multiple case designs. For obvious reasons, tool cases using preformed inserts are limited to specific tools/accessories and their sizes, limiting the applications of the tool case. Providing multiple preformed inserts to accommodate multiple tool case applications requires the cost and complexity of developing tooling and the storage/inventory control/numbering for these multiple inserts. Designs having individual sub-containers commonly position the sub-container(s) at specific locations within the cavity bounded by the exterior walls or by providing internal boundaries to retain the sub-containers to prevent their motion. This limits the organizational arrangement and potentially the sizes and types of tools/accessories within the tool case.

There is therefore a need for a tool container which can accommodate multiple types and quantities of tools and/or tool accessories, in addition to individual tool sub-containers, which allows each user to individually select the types and quantities of tools or sub-containers to be stored.

SUMMARY OF THE INVENTION

A tool and accessory container according to one aspect of the present invention includes first and second container members rotatably connectable to create an inner compartment. Each member has a compartment outer wall and integrally formed perimeter walls. A grid system is created on an inner compartment facing surface of at least one of the compartment outer walls. The grid system includes a plurality of receptacles arranged in each of a plurality of rows and columns. Each row and each column has a subset of the receptacles substantially equally spaced.

A tool and accessory container according to another aspect of the present invention includes one or more tool packages each having at least one male peg member. Each male peg member releasably engages within selected ones of the receptacles of the grid system such that each tool package is positionable in multiple locations and orientations about the grid system.

According to yet another aspect of the present invention, a method for mounting tool packages in a tool holding container includes the steps of: rotatably joining first and second container members to create an inner compartment; co-molding each of the container members to include a grid system; and releasably engaging at least one male peg member of at least one tool package within selected receptacles of the grid system.

The tool and accessory container of the present invention offers several advantages. The grid system of receptacles created in the inner compartment facing sides of the compartment outer walls provides multiple locations to releasably mount tool packages. Individual tool packages having one or more tools and/or tool accessories are provided with one or more male pegs spaced to align with multiple receptacles. The packages can therefore be located in multiple positions within the container and rotated in one or more orientations. Multiple sizes and orientations of tool packages can be simultaneously accommodated, providing a user with individual control of tool package location and individual control of which tool package(s) to store.

Further areas of applicability of the present invention will become apparent from the detailed description provided hereinafter. It should be understood that the detailed description and specific examples, while indicating a preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
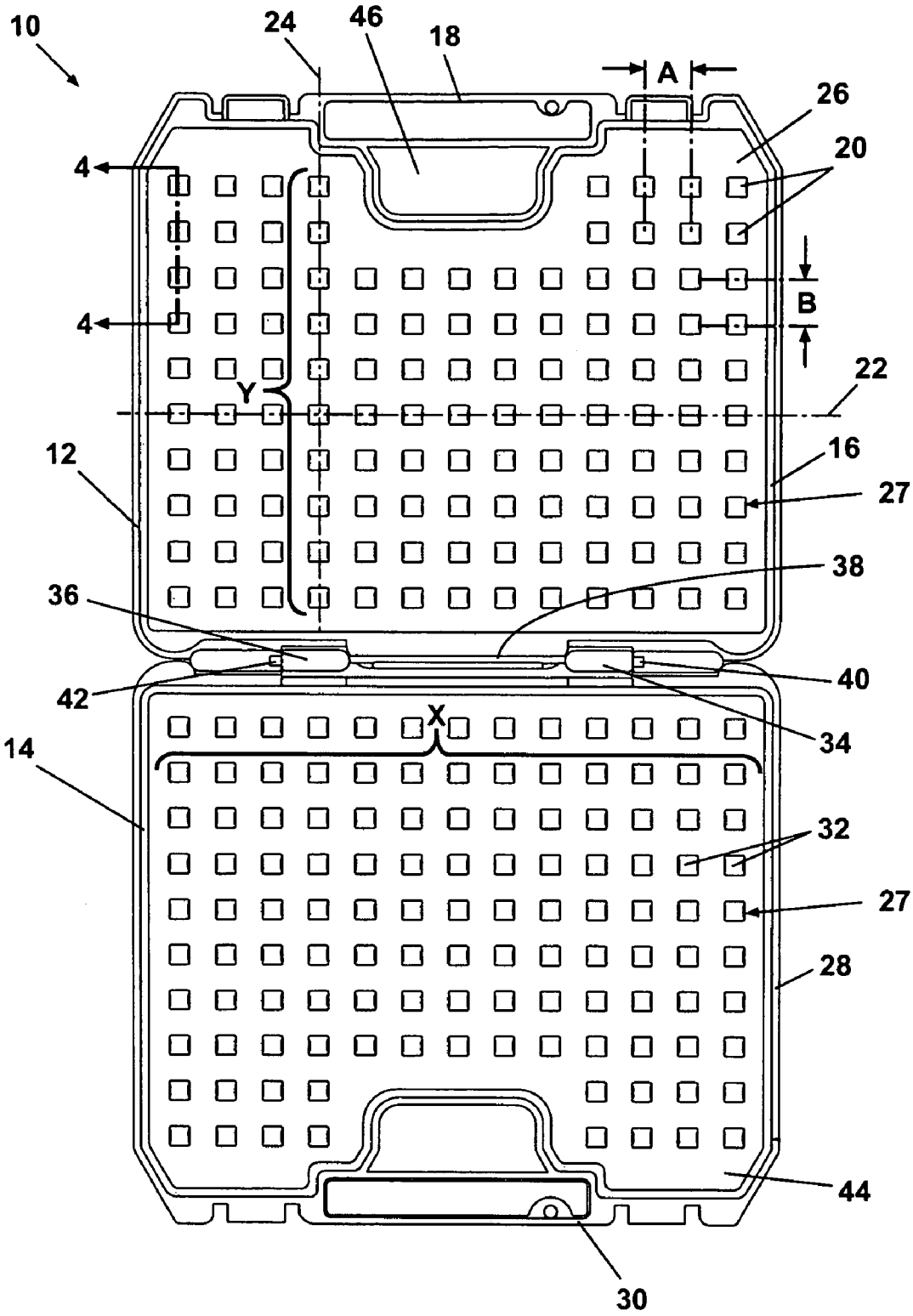
FIG. 1 is a plan view of a tool and accessory container according to a preferred embodiment of the present invention.

According to a preferred embodiment of the present invention and referring generally to FIG. 1, a tool container 10 includes a first portion 12 and a second portion 14. First portion 12 includes a perimeter wall 16, a first handle portion 18, and a plurality of receptacles 20. In one aspect of the invention, each of the receptacles 20 are substantially rectangular in shape and are arranged as subsets of receptacles in each of a plurality of subset rows 22 and subset columns 24 of receptacles 20. The receptacles 20 in each subset row 22 are generally arranged with equivalent row spacing "A". Similarly, receptacles 20 in each subset column 24 are arranged with generally equivalent receptacle column spacing "B". In one preferred embodiment of the present invention, receptacle row spacing "A" and receptacle column spacing "B" are substantially equivalent. Adjacent rows 22 of receptacles 20 are also substantially equally spaced and parallel to each other as are each adjacent column 24 of receptacles 20. A grid system 27 of receptacles 20 is thereby formed having each of receptacles 20 generally configured at predetermined distances and orientations with respect to each other.

Each of the receptacles 20 are formed in a receptacle surface at a time of formation of tool container 10. In a preferred embodiment of the present invention, tool container 10 is blow molded from a polymeric material. Blow molding provides rapid and accurate production of tool containers 10. Materials used in a preferred embodiment of the present invention include polyethylene and/or high density polyethylene. The invention is not limited to a particular type of polymeric material or to the molding method. Alternate polymeric materials can also be used as well as alternate molding methods such as injection molding and extrusion molding.

In a preferred embodiment, second portion 14 is substantially a mirror image of first portion 12 with minor differences in the handle or hinge engagement elements. Second portion 14 includes a perimeter wall 28 which in a closed condition of tool container 10 abuts perimeter wall 16. A second handle portion 30 is provided with second portion 14. Second handle portion 30 engages with first handle portion 18 using one of a plurality of handle engagement devices which do not form a portion of the invention herein and are therefore not further discussed herein. Similar to first portion 12, in one preferred embodiment second portion 14 includes a plurality of receptacles 32 which are sized and spaced similar to receptacles 20 of first portion 12. It is not critical for the invention that receptacles 32 align with receptacles 20 of first portion 12, however, tooling is simplified if the receptacles do align between respective portions 12 and 14. First and second portions 12, 14 are rotatably connectible by a first hinge 34 and a second hinge 36 using a hinge pin 38. A first hinge pin retainer 40 and a second hinge pin retainer 42 engage hinge pin 30 allowing rotation about hinge pin 38 within each of first and second hinges 34, 36 respectively. Second portion 14 also provides a receptacle surface 44 similar to receptacle surface 26 of first portion 12. A cavity 46 in each of first and second portions 12, 14 provides for a user's hand clearance about first handle portion 18 and second handle portion 30 when tool container 10 is in a closed condition. An open condition of tool container 10 is shown in FIG. 1.

Figure 2:
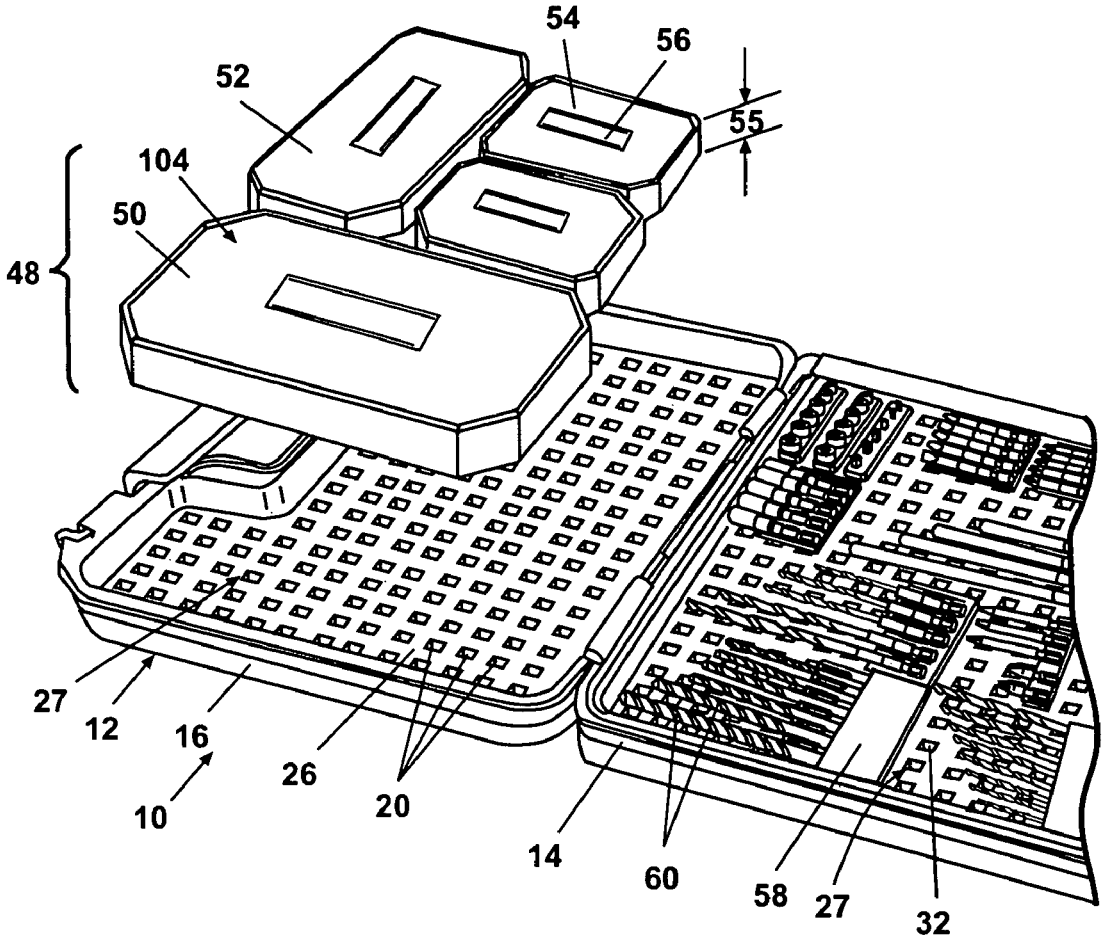
FIG. 2 is a perspective view of the tool and accessory container shown in FIG. 1 further showing exemplary tool and tool accessory items.

Referring now to FIG. 2, an exemplary tool package 48 which can be stored in tool container 10 includes a first tool container 50, a second tool container 52, and one or more third tool containers 54. First, second and third tool containers 50, 52, 54 can each be of equivalent size or as shown can be of varying sizes in the example of FIG. 2. Each of first, second and third tool containers 50, 52, 54 can be pre-designated to hold an individual type of tool (not shown). Each tool container of tool package 48 is engaged with one or more of receptacles 20 and therefore abut receptacle surface 26 in an installed position. Each tool container of tool package 48 can be rearranged from the general orientation shown in FIG. 2 such that any one of first, second or third tool containers 50, 52, 54 can either abut or be spatially separated from perimeter wall 16 of first portion 12. First, second and third tool containers 50, 52, 54 include a maximum depth 55 such that when each is engaged with receptacle surface 26 each is contained within the height of perimeter wall 16 and therefore do not interfere with items contained in second portion 14. In an alternate embodiment, not shown, maximum height 55 can be sized such that first, second, and/or third tool containers 50, 52 and 54 can occupy all the available storage space of both first and second portions 12, 14 or portions thereof.

FIG. 2 also identifies a plurality of different types of open tool holders 58 which can be stored by an alternate tool package 48 of tool container 10. Open tool holders 58 are shown installed in second portion 14 and retained by the plurality of receptacles 32 of grid system 27. Each open tool holder 58 can include one or more individual tools 60. Each of individual tools 60 can generally be accessed without removal of or an opening step of tool holders 58. Optionally, tools 60 can be removed after removal of open tool holders 58 from second portion 14.

Figure 3:
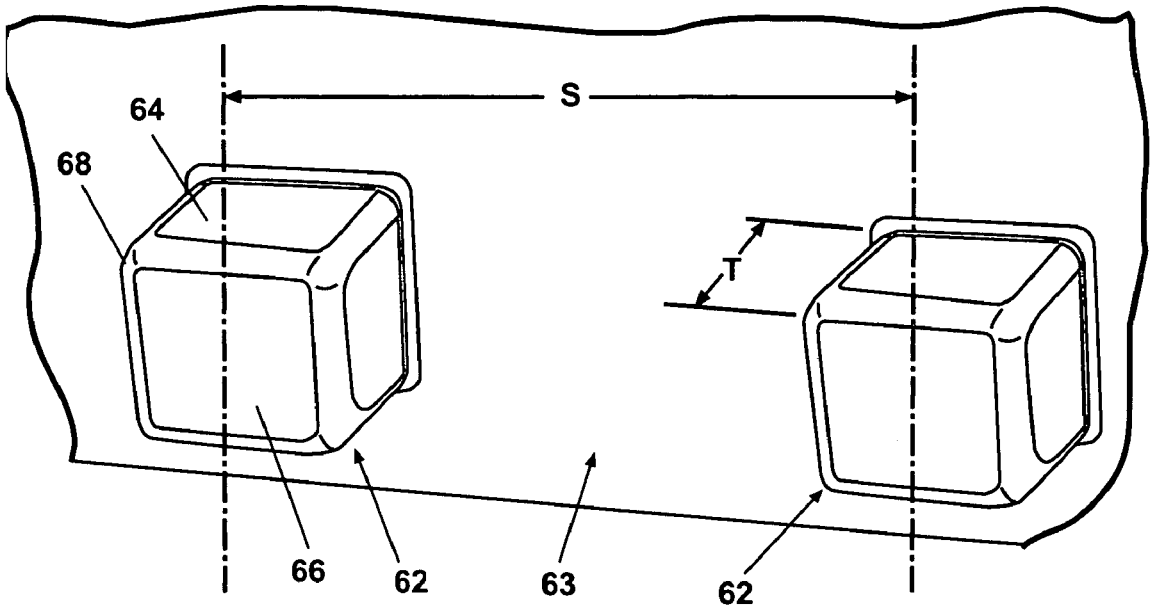
FIG. 3 is a perspective view of a male engagement peg design of the present invention.

As best seen in FIG. 3, each of the tool containers 50, 52 and/or 54 of tool package 48 as well as each of the individual open tool holders 58 include one or more male pegs 62 extending from a mounting face 63 thereof. Each male peg 62 includes four substantially flat sides 64 and an end face 66 distally extending from mounting face 63 and substantially parallel with mounting face 63. Each of the flat sides 64 is substantially perpendicular to mounting face 63 in one preferred embodiment of the present invention. In another aspect of the invention (not shown) flat sides 64 taper slightly toward end face 66 and are therefore not substantially perpendicular to mounting face 63. In a further aspect of the present invention (not shown), flat sides 64 taper inwardly from end face 66 toward mounting face 63 such that end face 66 provides a bulbous head to engage with receptacles 20 or 32. Male pegs 62 are spaced to mate with one or more of the rows 22 and/or columns 24 of receptacles 20 of first portion 12 or of receptacles 32 of second portion 14. Male pegs 62 are spaced at a spacing dimension "S" which is a non-zero whole number multiple of receptacle row spacing dimension "A" and/or receptacle column spacing "B", including applications having substantially equivalent spacing (multiple=1). Male pegs 62 further include substantially rounded corners 68 to assist during entry of male pegs 62 into any of receptacles 20 or receptacles 32. The total geometry of each male peg 62 is configured to provide a friction fit with receptacles 20 or receptacles 32. A height "T" of each male peg 62 is predetermined to substantially fully engage within each receptacle 20 or receptacle 32.

Figure 4:
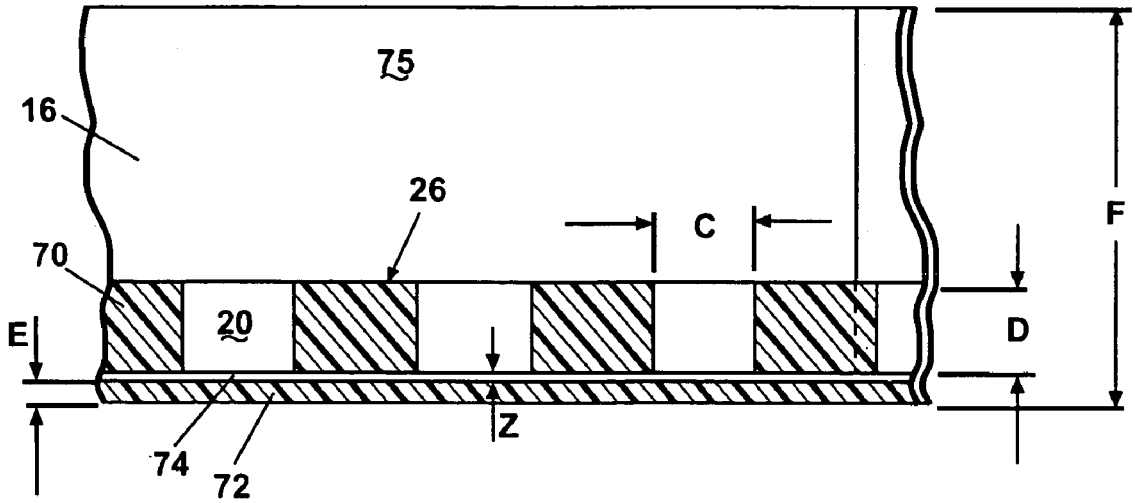
FIG. 4 is a partial cross-sectional view taken at section 4 of FIG. 1.

Referring now to FIG. 4, one preferred embodiment for the interface of receptacles 20 and a case wall is shown for first portion 12. Second portion 14 is similarly formed but not shown for simplicity. In this embodiment, receptacle surface 26 is defined by a receptacle wall 70 which is blow molded at the same time but as a separate wall from a case outer wall 72. A cavity 74 is therefore formed between case outer wall 72 and receptacle wall 70. The plurality of receptacles 20 are formed during the molding process within receptacle wall 70. Each receptacle 20 (as well as receptacle 32) includes a receptacle opening width "C" and a receptacle depth "D". In this embodiment, receptacle depth "D" is substantially equal to a total thickness of receptacle wall 70. Receptacle depth "D" is preferably substantially equal to male peg height "T", but can also be a lesser percentage of male peg height "T" to reduce the amount and weight of material used. Receptacle surface 26 is positioned as close as possible to case outer wall 72 to maximize a usable space within tool container 10 which is predetermined by a perimeter wall height "F". Maximum height 55 of the tool containers of tool package 48 and/or open tool holders 58 is therefore limited to the clearance provided between receptacle surface 26 within the perimeter wall height "F" after subtracting receptacle depth "D", a container outer wall thickness "E" and a depth of cavity 74. In another aspect of the invention, receptacle depth "D" plus a clearance depth "Z" of cavity 74 equal or exceed male peg height "T". This allows receptacle depth "D" and therefore the amount of polymeric material of receptacle wall 70 to be reduced, reducing weight and cost of tool container 10.

Figure 5:
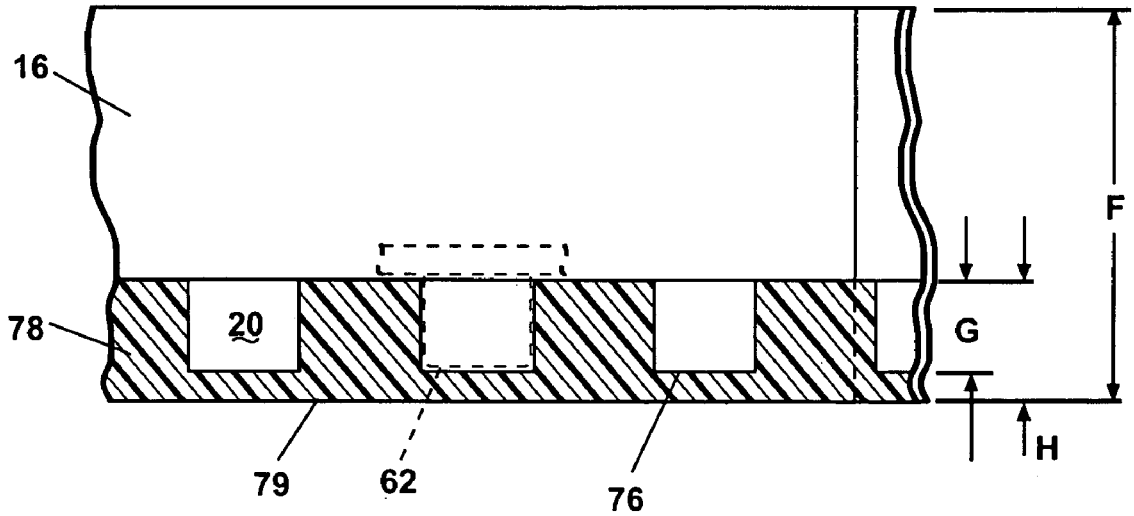
FIG. 5 is a partial cross-sectional view similar to FIG. 4 showing another preferred embodiment of the present invention.

Referring next to FIG. 5, in another aspect of the present invention cavity 74 shown in FIG. 4 is eliminated and an integral case outer wall 78 therefore includes the plurality of either receptacles 20 or receptacles 32 formed during the blow molding process of integral case outer wall 78. A depth "G" of each receptacle within integral case outer wall 78 is substantially equal to or greater than receptacle depth "D". A receptacle bottom wall 76 of each receptacle 20 and/or 32 is positioned as close as possible to an outer face 79 of integral case outer wall 78. A resulting outer wall thickness "H" is therefore minimized to maintain bottom walls 76 as close as possible to outer face 79 while maintaining structural integrity of tool container 10. An exemplary male peg 62 is shown in phantom in FIG. 5 depicting a typical installation of male peg 62 within one of the receptacles 20.

Figure 6:
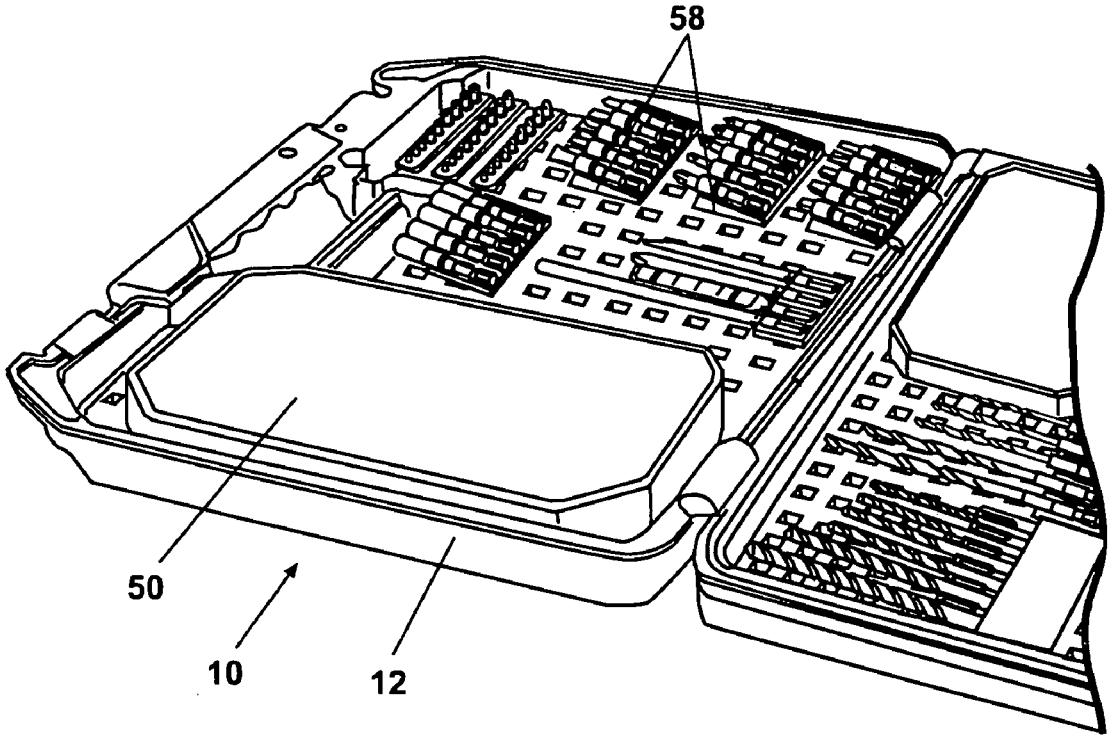
FIG. 6 is a perspective view similar to FIG. 2 showing further exemplary storage aspects of the present invention.

As best seen in FIG. 6, in another aspect of the present invention, tool container 10 can provide a plurality of tool packages 48 each having a different combination of individual items such as first tool container 50 and a plurality of open tool holders 58. This provides for a plurality of individual arrangements of tool container 10 which allows maximum flexibility to either the manufacturer or sales entity or the individual user of tool container 10. A plurality of similar configurations can also be provided for any combination of tool package 48 with open tool holders 58.

Figure 7:
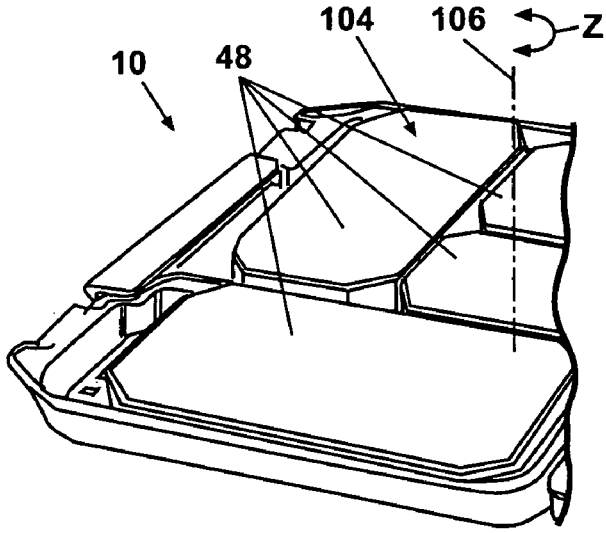
FIG. 7 is a perspective view similar to FIG. 2 showing still further exemplary storage aspects of the present invention.

Referring specifically to FIG. 7, tool package 48 shown in FIG. 2 is positioned in the installed condition. By selection of individual items for tool container 10, the available storage space for either first or second portion 12, 14 can be maximized. It is further noted, however, that the flexibility provided by the receptacle grid system 27 of the present invention does not require that the selected tool containers and/or the open tool holders completely fill the available volume of tool container 10.

Figure 8:
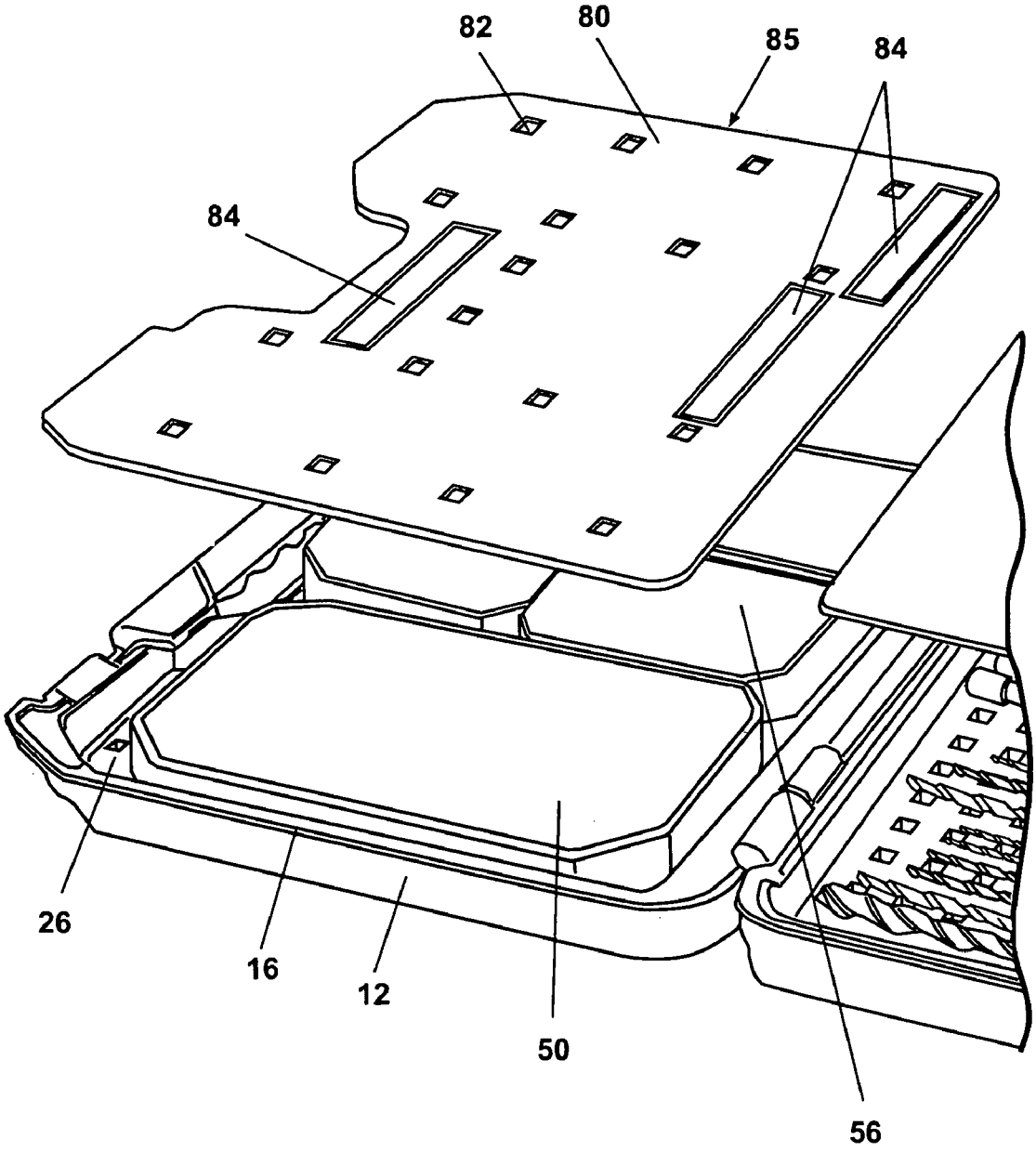
FIG. 8 is a perspective view of an exemplary insert card according to another aspect of the present invention.

Referring generally now to FIG. 8, and according to another preferred embodiment of the present invention, a specific configuration of tool package 48 and/or open tool holder 58 can be provided by pre-positioning an insert card 80 within either first or second portion 12, 14 before installation of the tool containers or the open tool holders. Insert cards 80 provide a predetermined pattern of receptacles 82 which align with individual ones of either receptacles 20 or receptacles 32. By the predetermined pattern of receptacles 82, a predetermined orientation, location and/or quantity of tool containers 50, 52 and/or 54 and/or open tool holders 58 is provided for. Insert cards 80 are formed such that a perimeter 85 closely matches the shape of receptacle surface 26. This pre-aligns the selected or predetermined receptacles 82 with the predetermined ones of receptacles 20 or 32 of first or second portions 12, 14. The male peg(s) 62 of each of the tool containers of tool package 48 and/or the open tool holders 58 are inserted through both predetermined receptacles 82 and the aligned ones of either receptacles 20 or receptacles 32.

FIG. 8 further identifies that one or more tool type indicias 84 are applied to insert cards 80 to direct the user to the specific arrangement of tool containers and/or open tool holders within tool container 10. When polymeric material is used, insert cards 80 are preferably formed using an injection molding process rather than a blow molding process, due to the greater degree of accuracy of location required for each of the predetermined receptacles 82. In one embodiment, insert cards 80 are formed from a polymeric material such as acrylonitrile styrene (ABS) or an ABS/polycarbonate combination material. In another embodiment, a material for insert cards 80 is a paper or fiber material such as cardboard which is cut or stamped to the desired geometry and having one or more of the tool type indicia 84 provided thereon. A thickness of insert cards 80 is minimized to maximize the usable space within tool container 10.

A material for each of the tool containers 50, 52, 54 of tool package 48 is preferably a translucent polymeric material such that the tool type indicia 84 are visible through the containers in their installed locations. Insert cards 80 can be provided as a total or as a fractional portion of the total surface area of receptacle surface 26, providing alignment between predetermined receptacles 82 and either receptacles 20 or 32 is maintained.

Figure 9:
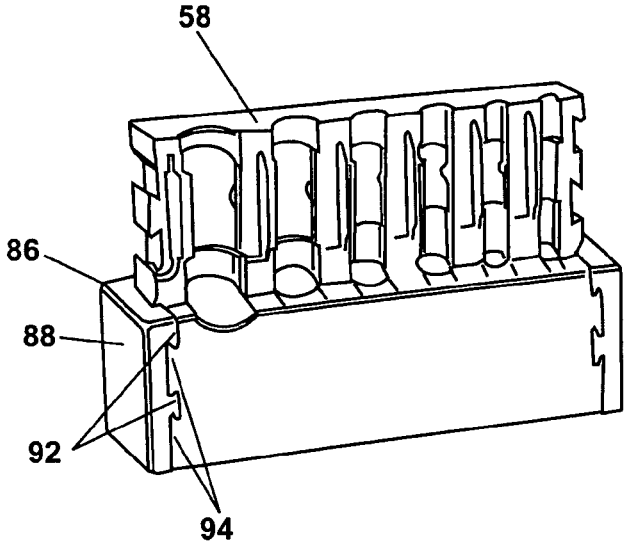
FIG. 9 is a perspective view of a tool accessory adapter according to one embodiment of the present invention.
Figure 10:
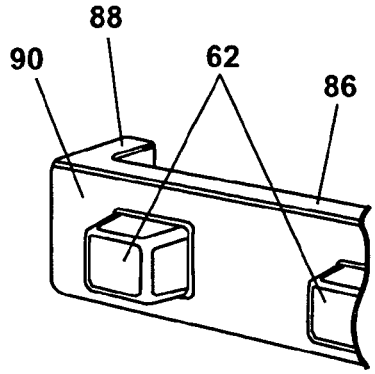
FIG. 10 is a rear perspective view of the adapter of FIG. 9, showing male engagement pegs extending from the adapter.

Referring now to FIGS. 9 and 10, an insert 86 acts as an adapter to mount an open tool holder 58 to tool container 10. Insert 86 includes a dovetail wall 88 and a mounting face 90 having one or more male pegs 62. Dovetail wall 88 includes one or more dovetail pins 92 which receive one or more dovetail tails 94 of open tool holder 58. The combination of insert 86 and open tool holder 58 is then frictionally engaged using the one or more male pegs 62 to either receptacles 20 or receptacles 32 of tool container 10.

Figure 11:
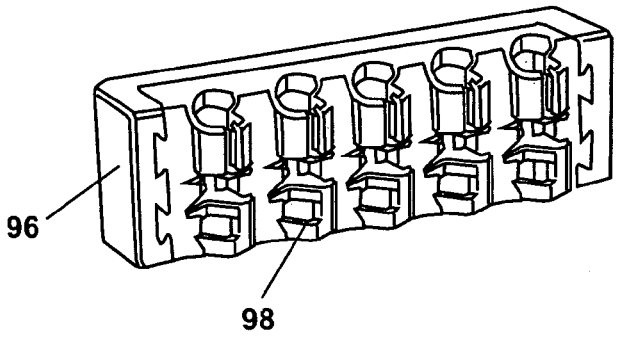
FIG. 11 is a perspective view of another embodiment of a tool accessory adapter of the present invention.
Figure 12:
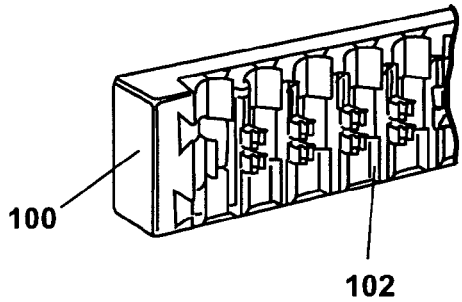
FIG. 12 is a perspective view of yet another embodiment of a tool accessory adapter according to the present invention.

Referring generally now to FIGS. 11 and 12, additional embodiments of adapters to mount open tool holders are shown. An insert 96 is adapted to mate with a slide-in tool holder 98 using the dovetail joints described in reference to FIG. 9. An insert 100 is similarly adapted to receive a snap-in tool holder 102.

Referring back to FIGS. 6 and 7, one or more of the first, second or third tool containers 50,52,54 and/or the open tool holders 58 can be grouped to form a tool package 48. At least one of the first, second and/or third tool containers 50,52,54 can be provided with an openable door 104 to access tools stored therein without removal of the tool container. At least one of the first, second and/or third tool containers 50,52,54 or the open tool holders 58 can also be rotatable in approximately 90 degree increments (limited by the rectangular shape of male pegs 62) about an axis of rotation "Z" of the container or open tool holder prior to engagement within the receptacles 20 or 32. In alternate embodiments (not shown), male pegs 62 and receptacles 20 and 32 can be provided in different geometrical shapes, including but not limited to: round; hexagonal; triangular, etc. The degree of rotation of the first, second and/or third tool containers 50,52,54 or the open tool holders 58 of the alternate embodiments is therefore limited by the geometry used for male pegs 62 and the proximity to the perimeter walls 16 or 28.

Figure 13:
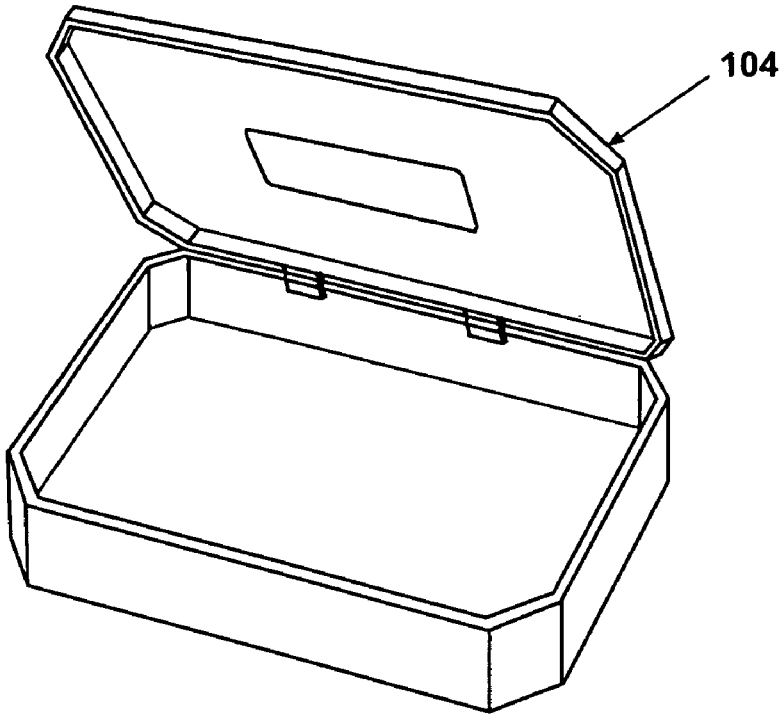
FIG. 13 is a perspective view of an exemplary storage container adapted to provide a separately opening lid according to a preferred embodiment of the present invention.
Figure 14:
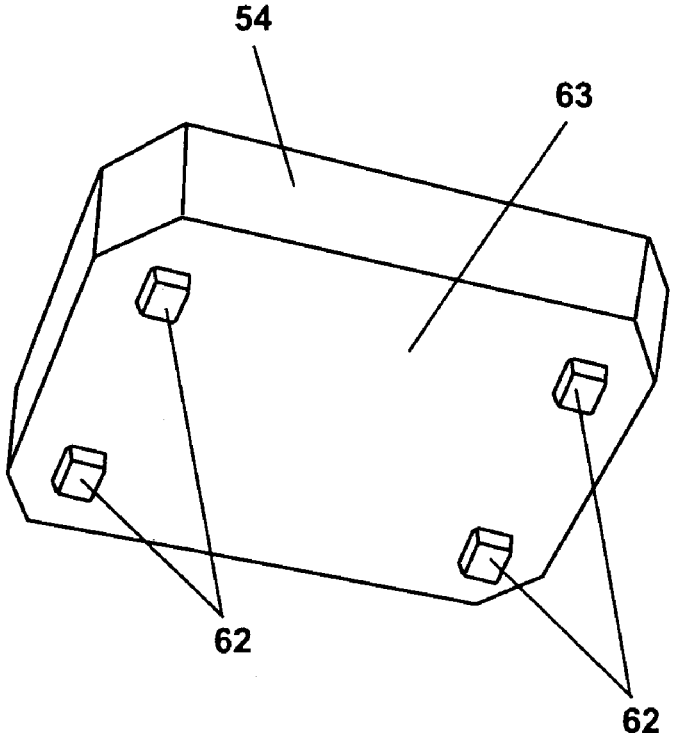
FIG. 14 is a bottom perspective view of the storage container of FIG. 13 having four male engagement pegs.

Referring now to FIGS. 13 and 14, an exemplary tool container 54 having openable door 104 in the open position is shown. One or more hinges are provided to permit rotation of openable door 104. As specifically seen in FIG. 14, in this exemplary design, four male pegs 62 spaced in a generally rectangular configuration are provided. Each of the male pegs 62 is provided in a predetermined multiple of spacing "S" (described in reference to FIG. 3) to the other male pegs 62 so that alignment of all of the male pegs 62 is provided with grid system 27.

A tool and accessory container 10 of the present invention offers several advantages. The grid system 27 of receptacles 20,32 created in the inner compartment facing sides of the compartment outer walls 72,79 provides multiple locations to releasably mount tool packages 48. Individual tool packages 48 having one or more tools and/or tool accessories are provided with one or more male pegs 62 spaced to align with the receptacles. The components of packages 48 can therefore be located in multiple positions within the container 10 and rotated in one or more orientations. Multiple sizes and/or orientations of tool packages 48 can be accommodated, providing a user with individual control of tool package location and individual control of which tool package(s) to store. The grid system 27 for tool containers of the present invention permits multiple uses for a single container design. A further advantage is provided by the use of adapters or insert cards which can broaden or selectively control the types and locations of tool packages.

The description of the invention is merely exemplary in nature and, thus, variations that do not depart from the gist of the invention are intended to be within the scope of the invention. For example, the rows and columns of receptacles of the present invention can be arranged such that neither the rows or columns are parallel to any of the perimeter walls. The female shape of the receptacles and the male shape of the pins can also be reversed such that the grid system 27 includes female receptacles positioned on the tool packages and therefore the mating male pins are substituted for the receptacles on surfaces 26 and 44 respectively. Blow molded tool container components are described as one preferred embodiment, however alternate molding processes can also be used to form the components of the present invention. Such variations are not to be regarded as a departure from the spirit and scope of the invention.

What is claimed is:

1. A tool container, comprising:

first and second container members rotatably connectable to create an inner compartment having compartment inner facing walls; and a grid system homogenously formed on at least one of the compartment inner facing walls, the at least one of the compartment inner facing walls having the grid system defining a receptacle wall, the grid system including a plurality of female rectangular receptacles created within the receptacle wall and divisibly arranged in a plurality of rows, each row having a subset of substantially equally spaced ones of the receptacles.

2. The container of claim 1, wherein the receptacles of the grid system are adapted to releasably receive at least one tool package such that each tool package is positionable in multiple locations and orientations about the grid system.

3. The container of claim 1, further comprising:

a plurality of integrally formed perimeter walls created on each of the first and second container members; and at least one hinge member integrally created on the perimeter walls of each container member operable to rotatably connect the container members.

4. The container of claim 1, wherein the first and second container members each comprise a polymeric material.

5. The container of claim 4, wherein the first and second container members further comprise substantially mirror image blow molded members.

6. The container of claim 1, further comprising a handle integrally created on at least one of the first and second container members.

7. The container of claim 1, wherein the plurality of receptacles further comprise substantially equally sized receptacles.

8. The container of claim 1, wherein the rows of receptacles are substantially equally spaced from each other and each row of receptacles is substantially parallel to an adjacent row of receptacles.

9. The container of claim 1, wherein the plurality of receptacles are arranged in each of the plurality of rows and a plurality of columns, each of the rows and columns having a subset of substantially equally spaced ones of the receptacles.

10. The container of claim 9, wherein the rows of receptacles are substantially equally spaced from each other and each row of receptacles is substantially parallel to an adjacent row of receptacles, and the columns of receptacles are substantially equally spaced from each other and each column of receptacles is substantially parallel to an adjacent column of receptacles.

11. A tool container, comprising:

a first half;

a second half pivotally coupled to said first half;

a subcontainer;

a plurality of receptacles formed in at least one of said first half and said subcontainer;

a plurality of pins formed in the other of said first half and said subcontainer, said plurality of pins each being sized to engage a corresponding one of said plurality of receptacles so as to releasably couple said subcontainer and said first half; and an indicia card positionable between said subcontainer and a selected one of said first and second halves;

said indicia card including indicia identifying a preferred location operable to position said subcontainer and including a plurality of second receptacles each aligned with selected ones of said plurality of receptacles.

12. The tool container of claim 11, further comprising a second plurality of said receptacles formed in said second half.

13. The tool container of claim 12, further comprising a plurality of said subcontainers, each being locatable in a plurality of locations within one of said first half and said second half.

14. The tool container of claim 11, wherein said plurality of receptacles are configurable in a grid system having said plurality of receptacles divisibly arranged in each of a plurality of rows and columns, each row and each column having a subset of substantially equally spaced ones of said receptacles.

15. The tool container of claim 14, wherein said rows of receptacles are substantially equally spaced from each other and each row of receptacles is substantially parallel to an adjacent row of receptacles.

16. The container of claim 14, wherein said columns of receptacles are substantially equally spaced from each other and each column of receptacles is substantially parallel to an adjacent column of receptacles.

17. The tool container of claim 11, wherein each of said plurality of receptacles and said plurality of pins are selectable from one of a plurality of geometric shapes such that any one of said pins is matably receivable within any one of said receptacles.

18. The tool container of claim 11, each of said pins is engageable with any one of said receptacles using a frictional fit.

19. The tool container of claim 11, each of said pins is engageable with any one of said receptacles using an interference fit.

20. The tool container of claim 11, each of said pins is engageable with any one of said receptacles using a snap fit.

21. The tool container of claim 11, wherein each of said receptacles further comprises a female shaped receptacle.

22. The tool container of claim 11, wherein each of said receptacles further comprises a substantially rectangular-shaped receptacle.

23. The tool container of claim 11, wherein said plurality of receptacles further comprise substantially equally sized receptacles.

24. A tool container, comprising:

first and second container members rotatably connectable to create an inner compartment, each member having a compartment outer wall and integrally formed perimeter walls;

a receptacle system having a receptacle wall homogenously connected to each of the members and spatially separated from the compartment outer wall of each member defining an inner compartment facing surface of each member, the receptacle system including a plurality of female receptacles defining through cavities of each inner compartment facing surface and divisibly arranged in each of a plurality of rows and columns, each row and each column having a subset of substantially equally spaced ones of the receptacles, and each of the receptacles having at least four walls; and at least one tool package having at least one male pin member adapted to releasably engage within selected ones of the receptacles of the receptacle system such that each tool package is positionable in multiple locations and orientations about the receptacle system.

25. The container of claim 24, further comprising at least one hinge member integrally created on one of the perimeter walls of each container member operable to rotatably connect the container members.

26. The container of claim 24, further comprising a plurality of male pin members extendable from each tool package wherein a spacing of the male pin members equals a spacing of selected ones of the receptacles of the receptacle system.

27. The container of claim 26, wherein the male pin members of each tool package are pre-positioned to align with receptacles in different ones of the rows.

28. The container of claim 26, wherein the male pin members of each tool package are pre-positioned to align with receptacles in different ones of the columns.

29. The container of claim 26, wherein the male pin members of each tool package are pre-positioned to align with receptacles in different ones of both the rows and the columns.

30. The container of claim 24, further comprising:

an insert member positionable between at least a selected one of the tool packages and a selected one of the compartment outer walls;

wherein the insert member includes indicia identifying a preferred location about the receptacle system to operably position the selected tool package.

31. The container of claim 30, wherein at least one of the insert member and the selected tool package comprises a substantially transparent material such that the indicia of the insert member is visible through the tool package when the tool package is connected to the receptacle system.

32. A tool container, comprising:

first and second container members rotatably connectable to create an inner compartment, each member having a compartment outer wall and integrally formed perimeter walls;

a receptacle system created by an inner compartment facing surface adjacent at least one of the compartment outer walls, the receptacle system including a plurality of female receptacles divisibly arranged in each of a plurality of rows and columns, each row and each column having a subset of substantially equally spaced ones of the receptacles;

at least one tool package having at least one male pin member adapted to releasably engage within selected ones of the receptacles of the receptacle system such that each tool package is positionable in multiple locations and orientations about the receptacle system;

an adapter having at least one of the male pin members extending from a side of the adapter; and an engagement system incorporated in the adapter operable to receive an alternate tool package such that the alternate tool package is connectable to the receptacle system using the male pin member of the adapter.

33. The container of claim 32, wherein the engagement system further comprises at least one dove-tail joint.

34. A tool container, comprising:

first and second container members rotatably connectable to create an inner compartment, each member having a compartment outer wall and integrally formed perimeter walls;

a receptacle system created by an inner compartment facing surface adjacent at least one of the compartment outer walls, the receptacle system including a plurality of female receptacles divisibly arranged in each of a plurality of rows and columns, each row and each column having a subset of substantially equally spaced ones of the receptacles;

at least one tool package having at least one male pin member adapted to releasably engage within selected ones of the receptacles of the receptacle system such that each tool package is positionable in multiple locations and orientations about the receptacle system;

an insert member positionable between at least a selected one of the tool packages and a selected one of the compartment outer walls;

wherein the insert member includes indicia identifying a preferred location about the receptacle system to operably position the selected tool package; and wherein the insert member further includes a predetermined pattern of apertures alignable with a predetermined pattern of the receptacles to pre-define a position of the tool package on the receptacle system.

35. A tool container system, comprising:

first and second container members rotatably connectable to create an inner compartment, each member having a compartment outer wall and integrally formed perimeter walls;

a grid system homogenously formed on an inner compartment facing surface adjacent at least one of the compartment outer walls, the grid system including a plurality of female receptacles each having at least four engaging surfaces divisibly arranged in each of a plurality of perpendicularly arranged rows and columns, each row and each column having a subset of substantially equally spaced ones of the receptacles; and at least one tool package having a plurality of male peg members adapted to frictionally engage with each of the at least four engaging surfaces within selected ones of the receptacles of the grid system such that each tool package is positionable in multiple locations and orientations about the grid system;

wherein a spacing of the male peg members substantially equals a multiple of the spacing of the receptacles of the grid system.

36. The system of claim 35, wherein each tool package is rotatable about an axis of the tool package prior to engagement of the male peg members with the receptacles of the grid system.

37. The system of claim 36, wherein each tool package is rotatable in increments of approximately 90 degrees about the axis of the tool package prior to engagement of the male peg members with the receptacles of the grid system.

38. The system of claim 35, wherein each tool package is selectable from a plurality of tool package sizes.

39. The system of claim 35, wherein at least one of the tool packages further comprises an enclosure having an openable door.

40. A method for mounting tool packages in a tool container, the tool container including first and second container members having a grid system created on an inner compartment facing surface of at least one of the members, the grid system including a plurality of female receptacles divisibly arranged in each of a plurality of rows and columns, the method comprising:

forming each of the container members together with the grid system;

rotatably joining the first and second container members to operably define an inner compartment;

releasably engaging at least one male peg member of at least one tool package within selected ones of the receptacles of the grid system;

positioning an insert member between each tool package and the grid system prior to the engaging step; and aligning a predetermined pattern of apertures of each insert member with a predetermined pattern of the receptacles to limit a position of each tool package on the grid system.

41. The method of claim 40, further comprising repositioning each tool package in one of multiple locations about the grid system.

42. The method of claim 40, further comprising rotating each tool package to operably change an orientation angle of the tool package prior to the engaging step.

* * * * *